United States Patent [19]

Ott

[11] Patent Number: 4,661,915

[45] Date of Patent: Apr. 28, 1987

[54] ALLOPHONE VOCODER

[75] Inventor: Granville E. Ott, Lubbock, Tex.

[73] Assignee: Texas Instruments Incorporated, Dallas, Tex.

[21] Appl. No.: 289,604

[22] Filed: Aug. 3, 1981

[51] Int. Cl.[4] ..... G10L 5/00

[52] U.S. Cl. ..... 364/513.5; 381/51; 381/41; 381/44

[58] Field of Search ..... 179/1 SA, 1 SB, 1 SC, 179/1 SD, 1 SE, 1 SC; 364/51 B; 340/146.3 WD, 146.3 AQ

[56] References Cited

U.S. PATENT DOCUMENTS

| | | | |
|---|---|---|---|
| 4,100,370 | 7/1978 | Suzuki | 179/1 SD |
| 4,209,836 | 6/1980 | Wiggins, Jr. et al. | 364/718 |
| 4,234,761 | 11/1980 | Wiggins, Jr. et al. | 179/1 SM |
| 4,304,965 | 12/1981 | Blanton | 179/1 SA |

OTHER PUBLICATIONS

Olson, "Speech Processing Systems", IEEE Spectrum, Feb. 1964, pp. 90–102.

Flanagan, "Speech Analysis . . . Perception", Springer-Verlag, 1972, p. 15.

Schwartz et al.—"A Preliminary Design of a Phonetic Vocoder Based on a Diphone Model", *IEEE International Conference on Acoustics, Speech and Signal Processing (ICASSP 80) Proceeding,* vol. 1, pp. 32–35 (Apr. 9–11, 1980).

Flanagan—"Automatic Extraction of Formant Frequencies from Continuous Speech", *J. Acoust. Soc. Am.,* vol. 28, pp. 110–118 (Jan. 1956).

Dunn—"Methods of Measuring Vowel Formant Bandwidths", *J. Acoust. Soc. Am.,* vol. 33, pp. 1737–1746 (Dec. 1961).

Schafer et al.—"System for Automatic Formant Analysis of Voiced Speech", *J. Acoust. Soc. Am.,* vol. 47, pp. 634–648 (Feb. 1970).

Lin et al.-"Software Rules Give Personal Computer Real Word Power", *Electronics,* pp. 122–125 (Feb. 10, 1981).

Lin et al.—"Text-To-Speech Using LPC Allophone Stringing", *IEEE Transactions on Consumer Electronics,* vol. CE-27, pp. 144–152 (May 1981).

*Primary Examiner*—E. S. Matt Kemeny

*Attorney, Agent, or Firm*—William E. Hiller; James T. Comfort; Melvin Sharp

[57] ABSTRACT

An allophone vocoder which utilizes the inherent redundancy of the spoken language together with the automatic human filtering of speech so as to obtain a speech compression and recognition system. An analog speech signal is broken up into its phoneme components and encoded for transmission. The encoded phoneme sequence has a much higher compression rate than the analog speech signal. The phonemes are then either transmitted, stored, or used to generate directly an analogous allophone sequence so as to approximate the original speech signal. Due to the inherent redundancy of the spoken language, and the filtering effect of the human ear, variations or errors in the approximations of the phonemes received from the original speech signal are inconsequential to the comprehension ability of the final allophone synthesized speech.

10 Claims, 13 Drawing Figures

702 $b_0$ = PAUSE/$\overline{\text{PAUSE}}$ { 1 – PAUSE; 0 – NO PAUSE }

703 $b_1$ = VOICED/UNVOICED { 1 – VOICED; 0 – UNVOICED }

704 $b_2 - b_3$ = SLOPE { 3 – NOT ASSIGNED; 2 – NEGATIVE; 1 – POSITIVE; 0 – LEVEL }

705 $b_4 - b_7$ = FORMANT

706

| VALUE | FIRST DISTANCE (Hz) | SECOND DISTANCE (Hz) |
|---|---|---|
| 0 | 0–400 | 0–400 |
| 1 | 0–400 | 401–800 |
| 2 | 0–400 | 801–1200 |
| 3 | 0–400 | OVER 1200 |
| 4 | 401–800 | 0–400 |
| 5 | 401–800 | 401–800 |
| 6 | 401–800 | 801–1200 |
| 7 | 401–800 | OVER 1200 |
| 8 | 801–1200 | 0–400 |
| 9 | 801–1200 | 401–800 |
| 10 | 801–1200 | 801–1200 |
| 11 | 801–1200 | OVER 1200 |
| 12 | OVER 1200 | 0–400 |
| 13 | OVER 1200 | 401–800 |
| 14 | OVER 1200 | 801–1200 |
| 15 | OVER 1200 | OVER 1200 |

PHONEME-TO-ALLOPHONE RULES

PHONEME TO ALLOPHONE RULES FOR PRONOUNCING DICTIONARY.

LEGEND:

1001 b = BLANK, WORD BOUNDARY
$ = NASAL CONSONANT :M:N:NG:
% = ONE VOICED CONSONANT :B:D:G:J:L:M:N:NG:R:THV:V:W:Y:Z:ZH:
! = ONE VOICELESS CONSONANT :CH:F:H:K:P:S:SH:T:THF:
^ = ONE CONSONANT
: = ZERO OR MORE CONSONANTS
/ = PRIMARY OR SECONDARY STRESS :^:–:
; = ONE LABIAL CONSONANT :B:F:M:P:V:W:
@ = ONE VELAR CONSONANT :G:K:NG:
* = ONE PALATAL/ALVEOLAR CONSONANT :CH:D:J:N:S:SH:T:Y:Z:ZH:
+ = ONE HIGH-FRONT VOWEL :EE:EH:EI:I:
& = ONE CENTRAL VOWEL :AH:ER:UH:
# = ONE BACK-ROUND VOWEL :AW:OO:OW:U:
1002 · = SYLLABLE BOUNDARY :–:^:–:

Fig. 10a

B RULES

| | | |
|---|---|---|
| b[BR] | =/BR/ | AS IN /BROWN/ |
| · [BR] | =/BR/ | AS IN /ABRADE/ |
| b[BL] | =/BL/ | AS IN /BLACK/ |
| · [BL] | =/BL/ | AS IN /OBLIGE/ |
| b[B] | =/B/ | AS IN /BIKE/ |
| [B]b | =/B#/ | AS IN /GRAB/ |
| [B] | =/B*/ | AS IN /ABNEGATE/ |

1003

CH RULES

| | | |
|---|---|---|
| 1004 b[CH] | =/CH–/ | AS IN /CHAIN/ |
| [CH]b | =/CH#/ | AS IN /ITCH/ |
| 1005 [CH] | =/CH*/ | AS IN /BEWITCHING/ |

D RULES

| | | |
|---|---|---|
| b[DR] | =/DR/ | AS IN /DRIVE/ |
| · [DR] | =/DR/ | AS IN /REDRESS/ |
| b[D] | =/D–/ | AS IN /DIVE/ |
| [D]b | =/D#/ | AS IN /RIDE/ |
| [D]/UH | =/D!/ | AS IN /LADDER/ |
| [D]/I | =/D!/ | AS IN /RIDING/ |
| [D]/L | =/D!/ | AS IN /LADLE/ |
| [D]/N | =/D!/ | AS IN /LADEN/ |
| [D] | =/D*/ | AS IN /LADY/ |

Fig. 10b

ALLOPHONE VOCODER

BACKGROUND

This invention relates generally to speech and more particularly to speech recognition, compression, and transmission.

It has long been recognized that analog speech signals contain numerous redundant sounds so as to make such signals not suitable for efficient data transmission. In a direct human interaction situation this inefficiency is tolerable. The technical requirements to cope with inefficient speech transmission though become infeasible due to cost, time, and the increased memory storage which is rendered necessary because of the inefficiency.

A need exists for a system which can take an analog speech signal and translate it into a digital form which is reconstructable after transmission or storage. This type of device is generally referred to as a "vocoder".

A vocoder was discussed by Richard Schwartz et al in his paper entitled "A Preliminary Design of a Phonetic Vocoder Based on a Diphone Model" published in the IEEE International Conference on Acoustics, Speech and Signal Processing (ICASSP 80) proceedings of Apr. 9, 10, 11, 1980 in Denver, Colo. (ICASSP 80 vol. 1, pg. 32–35). The diphone model of Schwartz et al entails a phonetic vocoder operation at 100 b/s. With each phoneme of the speech, the vocoder generates a duration and single pitch value. An inventory of diphone templates is used to synthesize the phoneme string. Additionally the diphone templates are utilized to initially establish which phonemes are being transmitted in the analog speech. A diphone exists from the middle of one phoneme to the middle of the next phoneme. Due to the structure and stringing ability of a diphone, it is highly cumbersome in use and is generally ineffective in speech synthesis.

Diphone synthesis requires the use of an elaborate acoustic-to-phonetic rule algorithm so as to create intelligible speech. This extensive acoustic -to-phonetic rule algorithm requires a great deal of time and hardware to be effective.

Intrinsic to the recognition of an analog speech is the use of a methodology which breaks the analog speech into its component parts which may be compared to some library for identification. Numerous methods and apparatuses have evolved so as to approximate the human speech and to model it. These modeling techniques include the voder, linear predictive filters, and other devices.

One such method of analyzing the analog speech was discussed by James L Flanagan in the article "Automatic Extraction of Format Frequencies from Continuous Speech" first printed in *J. Acoust. Soc. Am.*, Vol. 28, pp. 110–118, January 1956, incorporated hereinto by reference.

In the article, Flanagan discusses two electronic devices which automatically extract the first three formant frequencies from continuous speech. These devices yield continuous DC output voltages whose magnitudes as functions of time represent the formant frequencies of the speech. Although the formant frequencies are in an analog form, use of an analog-digital (AD) converter readily transforms these formant frequencies into digital form which is more suitable for use in an electronic environment.

Another method was discussed by H. K. Dunn in his article "Methods of Measuring, Vowel Formant Bandwidths" *J. Acoust. Soc. Am.*, Vol. 33, pp. 1737–1746, December 1961, incorporated hereinto by reference. In the article, Dunn discloses the use of spectrums of real speech and the use of an artificial larynx in an application to real subjects.

It is clear therefore that an efficient methodology and apparatus for transformation of an analog speech signal to a approximating digital form does not exist. The mere recognition of formants or the use of diphones in the synthesis of the perceived speech is inaccurate and does not allow for quality recordation and transmission of data representation of the original speech signal.

DESCRIPTION OF THE INVENTION

The present embodiment employs means to separate the analog speech signal into phoneme parts. A comparison means establishes a match with a phoneme template. A reference code representative of the template is selected by an appropriate means. This invention achieves a data rate of 80 bits per second or less. The technique by which this rate is received still produces quality speech through the use of a phoneme-to-allophone translation. The input data is normalized as to its speed, pitch, and other indicia; this is compared to a set of phoneme templates, within a set or library of templates. An optimal match is made. The input pitch and variations are retained in a stored allophone string or sequence for replay or transmission.

Since the human ear acts as a filtering mechanism and also due to the inherent redundancy of the spoken language, any errors which are generated in the selection of the optimal phoneme match are minimized. For example, assume that the phoneme recognizer incorrectly matched the spoken phoneme "SH" to the phoneme "CH" in the phrase "We will be taking a cruise on the ship". This results in the phrase becoming "We will be taking a cruise on the chip". Although the transmitted phoneme sequence is not a perfect match, the total phrase is still intelligible to the listener since the human ear and the mental process filter out this incorrect phoneme. The human ear and mental process have developed over the years to compensate for variation in pronunciations and the incorrect usage of words.

Some applications of this allophone device vocoder are found in a digital dictating machine, a store and play telephone, voice memos, multi-channel voice communications, voice recorded exams, etc. In the situation of a dictating machine, the erroneous matching of the phonemes is more visible than in the synthesized speech situation; but it provides a rough draft or first cut to the document so as to be edited later.

An embodiment of the invention allows the apparatus to accept an initialization from the user so as to allow a normalization of the pitch and time parameters. This also allows the apparatus to create a library of phoneme templates which more closely approximates the actual user's phoneme structure.

At the compression rate of 80 b/sec, the signal becomes less expensive and more efficient in the use of transmission time and hardware specifications for storage.

This invention uses a phoneme-to-allophone matching algorithm, such that the quality of synthesized speech is vastly improved since allophones more closely map the human utterances.

This vocoder accepts the analog speech input and matches it to a set of phoneme templates; the phonemes each contain a phoneme code which is compressed into a sequence of phoneme codes and communicated via a channel. This channel should be as noise free as possible so as to provide accurate transmission. The sequence of phonemes is received and then translated to an analogous allophone sequence and synthesized through known electronic synthesis means.

One such means is discussed in U.S. Pat. No. 4,209,836 issued to Wiggins, Jr, et al on June 24, 1980, incorporated hereinto by reference. This speech synthesis integrated circuit device uses a linear predictive filter in its generation of the synthesized speech.

The control of the data within the synthesizer is well known in the art. One such method for communicating digital speech data and control of the memory for storing the data is disclosed in U.S. Pat. No. 4,234,761 issued to Wiggins, Jr., et al on Nov. 18, 1980, incorporated hereinto by reference.

In the invention, the phoneme recognizer contains an automatic gain control (AGC), a formant tracker, templates for the phonemes, and a recognition algorithm. The phoneme recognizer receives the voice input and automatically controls the gain of the voice and sends a signal to the formant tracker for analysis and formant extraction. The algorithm operates on the formants and features of the utterance requiring the detection of the phoneme boundary within the speech. The detected phoneme is matched to a phoneme in a library of phoneme templates. Each phoneme template has a corresponding identification code. The selected identification code is sequentially packed and transmitted via a transmission channel to a receiver.

The transmission channel may be either a wired or wireless communication medium. Ideally the transmission channel is as noiseless as possible so as to reduce errors.

The phoneme-to-allophone synthesizer receives the phoneme codes from the channel. The algorithm converts the phoneme sequence into an analogous allophone sequence and thereby produces quality speech. In the phoneme-to-allophone synthesizer, a control means sequentially directs a library of allophone characteristics to be communicated to a speech synthesizer.

The use of an efficient formant tracker is beneficial. A formant is a frequency component in the spectrum of speech which has large amplitude energy. It also has a resonant frequency of the pitch and a voiced sound. This resonant frequency is a multiple of a fundamental frequency. The first formant occurs between 200 to 850 Hertz (Hz), the second formant occurs between 850 and 2,500 Hz, and the third formant occurs between 2,500 and 3,500 Hz. This invention creates a formant tracker which keys upon the strong energy component in each frequency band.

The invention utilizes the technique of convolving the spectrum of the speech signal of interest with a sinusoidal signal having a frequency which is in integer multiple of the fundamental frequency. By varying the frequency of the sinusoidal signal and detecting the amplitude of the convolution, the formant is found in the selected frequency band.

In one embodiment of the formant tracker, it is constructed using a pitch tracker together with additional logic around it so as to determine the sinusoidal oscillation and to convolve the two functions over the chosen spectrum frequency.

A set of integers is generated so that when each is multiplied by the fundamental frequency, the product lies whein the formant range of interest. These three integer sets, one for each formant frequency range, should overlap sufficiently so as to allow the formant center to be sufficiently determined. The integers within each integer set are used to generate a sinusoidal signal based at the product of the integer with the fundamental frequency. The sinusoidal signal and the analog speech signal are integrated over a short time interval or frame. Mathematically, the integration of the two time signals yields a convolution of their spectra. By performing the integration for each integer, the maximum or largest magnitude becomes evident and the associated optimal integer determines a formant. The selected formant centers are determined by multiplying the optimal integer by the fundamental frequency. Each formant has associated therewith a bandwidth which is another indicia of the received analog speech data.

This indicia is combined with other indicia such as a pause or no pause, voice or unvoiced, a slope of the signal, and any other chosen data to generate a data value which is used to match to the library templates for phonemes.

One method of encoding the formant is to determine the distance between each formant and thereby achieve a reduction in the number of bits necessary to describe the formant selected.

The use of formant analysis in voiced speech is discussed by Schafer and Rabiner in their article "System For Automatic Formant Analysis of Voiced Speech" appearing in the *J. Acoust. Soc. Am.*, Vol. 47, pg. 634–648, February, 1970, incorporated hereinto by reference. Schafer and Rabiner utilized a gain control which varies with time and controls intensity of the output. A cascaded network is used to approximate a combination of the glottal-source spectrum and a radiation load spectrum. The analysis system determines, as a function of time the lowest three formants, the pitch period, and the gain.

Once the indicia is determined, an algorithm is used to match it to a particular approximated phoneme. In the preferred embodiment, a tree algorithm is used which strips away the infeasible possibilities so as to reduce the total number of computations required for matching. In this algorithm, since it is a tree approach, cycles in the decisional tree are strictly prohibited. A cycle in the decisional tree would allow the possibility of an ever cycling situation such that a decision is never reached.

Any algorithm which matches the perceived phoneme to a phoneme template is permittable so long as it does a best approximation. This includes the algorithm which generates a comparison value for each phoneme template relative to the received phoneme and then chooses the optimal comparison value.

Once the optimal phoneme has been matched to a code, the code is transmitted to a storage means, a printer means, or a synthesizer. Before synthesis, the phoneme string is mapped into its component allophone set and used to synthesize the speech. This mapping of a phoneme to an allophone set is discussed by Kun-Shan Lin, Gene A. Frantz, and Kathy Goudie in their article "Software Rules Give Personal Computer Real Word Power" appearing in *Electronics*, Feb. 10, 1981, pg. 122–125, incorporated hereinto by reference. This article discusses the use of software to analyze text and determine its component elements and thereafter to pronounce them via a speech synthesis chip.

Another algorithm was discussed by Kun-Shan Lin, Kathy Goudie, Gene Frantz, and George Brantingham in their article "Text-to-Speech Using LPC Allophone Stringing" appearing in *IEEE Transactions on Consumer Electronics,* Vol. CE 27, May 1981, pg. 144–152, incorporated hereinto by reference. This article discusses a response system for a text-to-speech conversion of any English text. The system utilizes an LPC synthesizer chip and a microprocessor. The system converts an input string of ASCII characters into allophonic codes with their synthesis to produce speech.

The use of allophones is extremely powerful since it permits any spoken speech to be recreated without being dependent upon language or a fixed library. The expanse of the allophonic and phoneme matching algorithm is the only limiting factor of the vocoder's ability.

Although the preferred embodiment is a phoneme-to-allophone mapping, other mapping sciences such as but not limited to phoneme-to-diphone, are also applicable.

The invention together with its particular embodiments and ramifications will be more fully explained by the following drawings and their accompanying descriptions.

DRAWINGS IN BRIEF

FIG. 1 is a block diagram of an embodiment of the invention illustrating the data compression and transmission capabilities of the invention.

FIG. *2a* is a block diagram of the communication relationship of the invention.

FIGS. *2b* and *2c* illustrate the recognition side and the synthesis side respectively of the embodiment illustrated in FIG. *2a.*

FIGS. 10*a* and 10*b* illustrate the translation of phonemes-to-allophones.

DRAWINGS IN DETAIL

Figure 1:
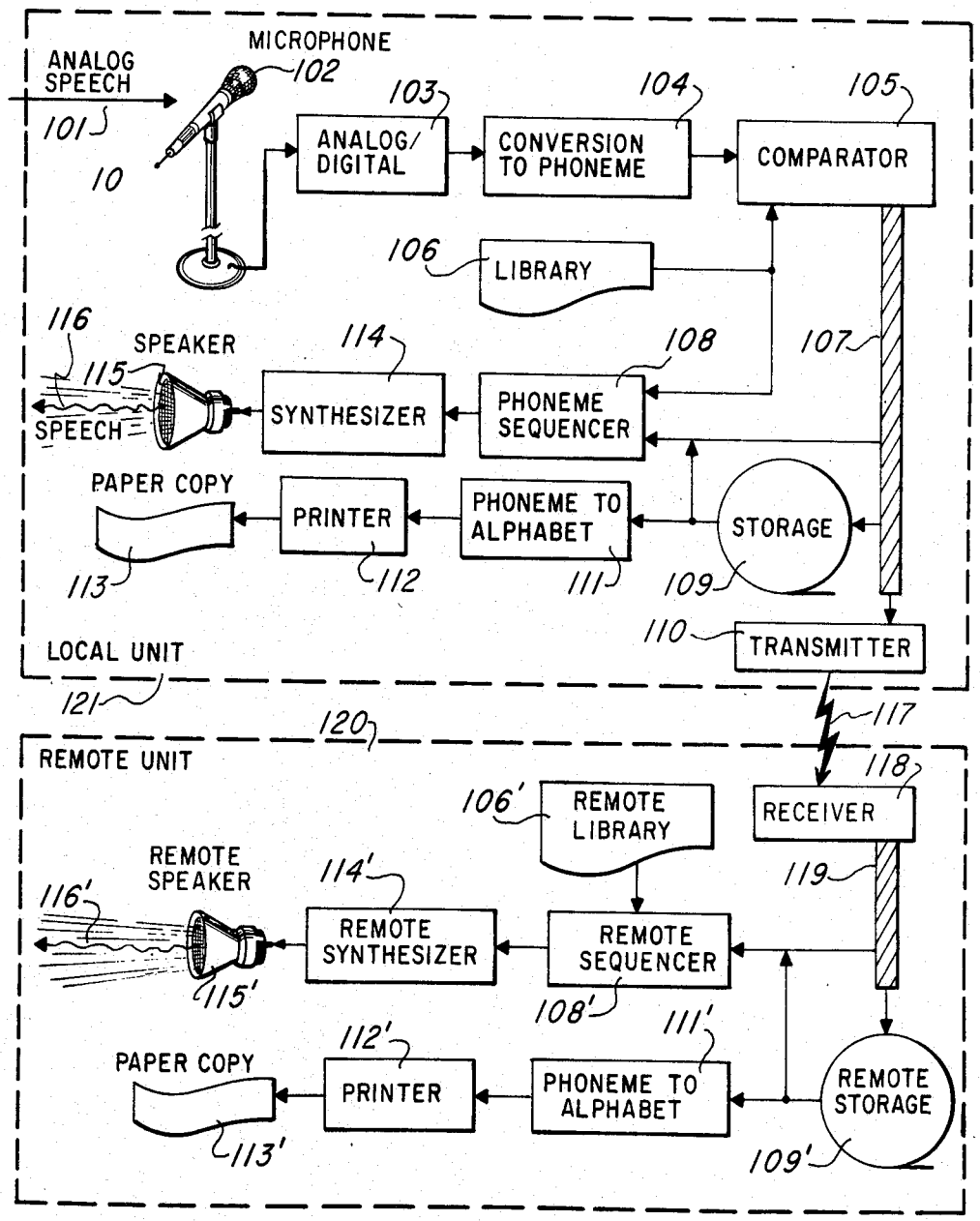

FIG. 1 illustrates in block diagram the capabilities of an embodiment of the invention.

Analog speech 101 is picked up by the microphone 102 and transmitted in analog form to the analog to digital (A/D) converter 103. Once the signal has been translated into digital form, it is converted to a perceived phoneme via the conversion means 104. Each perceived phoneme is communicated to the comparator 105 and referenced to templates in the library 106 so that a match is obtained. Once a matched phoneme is determined, its code is communicated via the bus 107 to either the phoneme sequencer 108, the storage means 109, or the transmitter 110.

The sequence code which matches to the phoneme sequence totally identifies the analog speech 101. This code sequence is more susceptible to being packed or for storage than the original analog speech 101 due to its digital nature.

The phoneme sequencer 108 utilizes the code communicated via the bus 107 to obtain the appropriate phoneme from the library 106. This phoneme from the library 106 has associated with it a set of allophone characteristics which are communicated to the synthesizer 114. The synthesizer 114 communicates an analog signal to operate speaker 115 in the generation of speech 116. Through the use of the phoneme-to-allophone translation as effectuated by the phoneme sequencer 108, with the aid of library 106, a more intelligible and higher quality speech 116 is generated. This translation ability permits the encoding of the data in a phoneme base so as to facilite a lower bit per second transmission rate and thus requires less time and storage medium for the recordation of the original analog speech 101.

Alternately, the phoneme codes are stored via storage means 109 for later retrieval. This later retrieval is optionally used by the phoneme sequencer 108, synthesizer 114, and speaker 115 sequence to again synthesize the phoneme sequence in allophone form for generation of speech 116. Optionally, the storage means 109 communicates the phoneme codes to the phoneme to alphabet converter 111 which translates the phonemes to their equivalent alphanumeric parts. Once the phonemes have been translated to the alphanumeric parts, such as in ASCII code, they are readily transmitted to the printer 112 so as to produce a paper copy 113 of the original analog speech 101.

This branch of the operation, the storage means 109, phoneme-to-alphabet converter 111, and printer 112, allows the invention to generate printed text from a speech input so as to permit an automatic dictating device.

Another alternative is for the phoneme codes from the bus 107 to be communicated to a transmitter 110. The transmitter generates signals 117 representative of the phoneme codes which are perceived by a remote unit 120 at its receiver 118.

The remote unit 120 contains the same capabilities as the transmitting unit 121. This entails the transmission of the phoneme code via a bus 119 from the receiver 118. Again, once the phoneme code is transmitted via the bus 119, it is susceptible for the remote storage means 109' or the remote sequencer 108'. In another embodiment of the invention the phoneme codes transmitted via the bus 119 are also communicatable to a remote transmitter, not shown.

The remote unit 120 utilizes the phoneme codes in the same manner as the local unit 121. The phoneme codes are utilized by the remote sequencer 108' in conjunction with the data in the remote library 106' to generate an analogous allophone sequence which is communicated to the remote synthesizer 114'. The remote synthesizer 114' controls the operation of the remote speaker 115' in generating the speech 116'. The remote unit 120 also has the option of storing the phoneme code at the remote storage means 109' for later use by the remote sequencer 108' or the phoneme to alphabet converter 111'. The phoneme-to-alphabet converter 111' translates the phoneme code to its analogous alphanumeric symbols which are communicated to the printer 112' to generate a paper copy 113'.

It is clear from this embodiment of the invention that the analog speech is translated to a phoneme code which is more susceptible to storage or for manipulation as a data string. The phoneme code permits easy storage, transmission, generation of a printed copy or eventual synthesis by translation to an analogous allophone sequence.

Figure 2A:
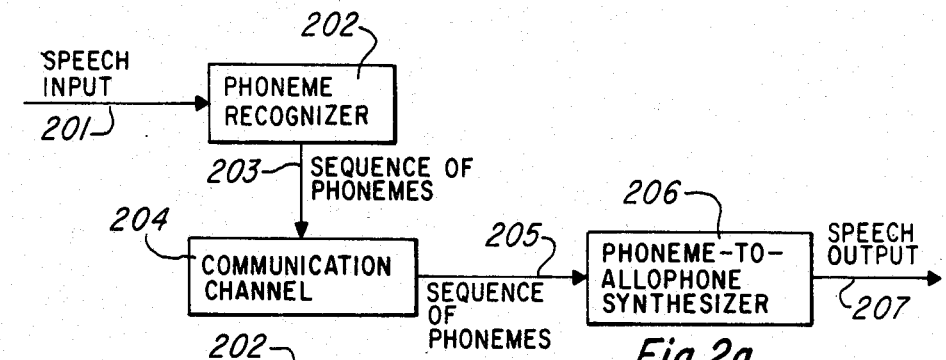

FIG. 2*a* illustrates, in block form, an embodiment of the invention which receives the analog speech input and results in a speech output.

In the embodiment of FIG. 2*a*, the original analog speech signal input 201 is communicated to a phoneme recognizer 202 which generates a sequence of phonemes 203 via a communication channel 204. The sequence of phonemes 205 is communicated to a phoneme-to-allophone synthesizer 206 which translates the phoneme sequence into its analogous allophone sequence so as to generate the speech output 207. It should be noted that the phoneme recognizer 202 and the phoneme-to-allophone synthesizer 206 are alternatively in the same unit, or are remote one from the other. In this context the communication channel 204 is either a hard wired device such as bus or a telephone line or a radio transmitter with receiver.

Figure 2B:
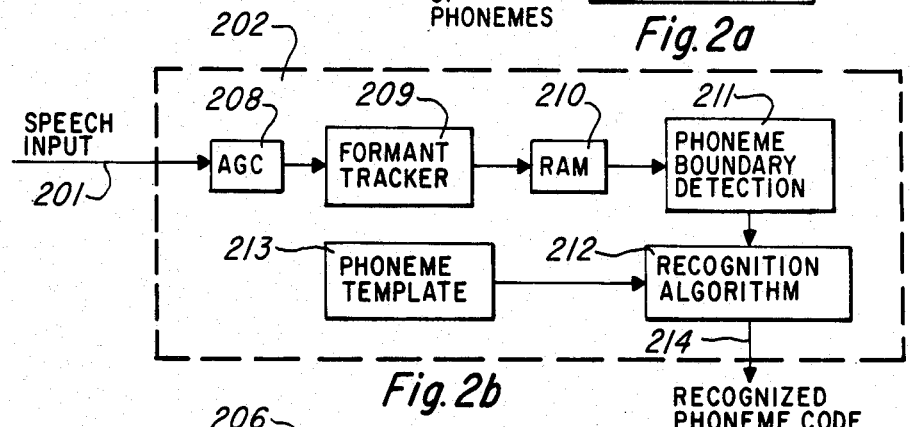

FIG. 2*b* illustrates an embodiment of the phoneme recognizer 202 illustrated in FIG. 2*a*.

The analog speech signal input 201 is communicated to an automatic gain control circuit (AGC) 208 so as to regulate the speech signal into a certain desirable balance. The formant tracker 209 breaks the analog signal into its formant components which are stored in a random access memory (RAM) 210. Although in this embodiment the use of a RAM 210 is illustrated, it is contemplated that any suitable storage means could be employed. The formants stored in RAM 210 are communicated to the phoneme boundary detection means 211 so as to group the formants into perceived phoneme components. Each perceived phoneme is communicated to the recognition algorithm 212 which untilizes the phoneme templates from the library 213 which is comprised of known phonemes. A best match is made between the perceived phoneme from the phoneme boundary detection means 211 and the templates found in the phoneme template library 213 by the recognition algorithm 212 so as to generate a recognized phoneme code 214.

As noted earlier, a best match is obtained, even if not a perfect recognition, since the natural filtering of the human ear and the error correction of the mental processes of the listener minimize any error generated by the recognition algorithm 212. The recognition algorithm 212 provides a continuous sequence of phoneme codes so that a blank or non-recognized phoneme does not exist in the sequence. A blank for a non-recognition determination only results in an increase in the noise of the invention.

Figure 2C:
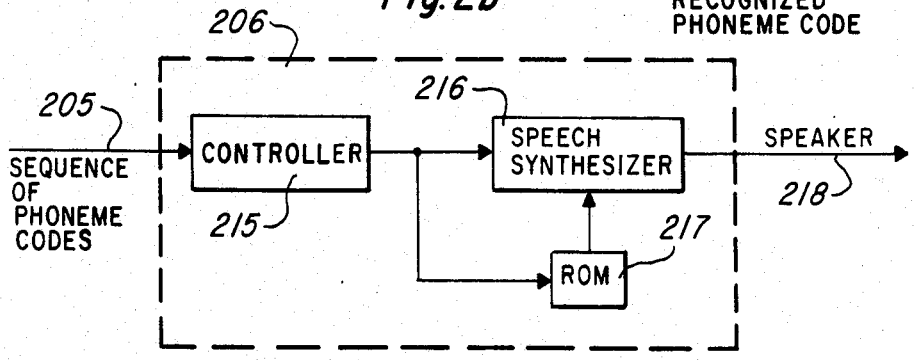

FIG. 2*c* illustrates an embodiment of the phoneme-to-allowance synthesizer 206.

The sequence of phoneme codes 205 is communicated to the controller 215. The controller 215 utilizes these codes and its prompting of the read only memory (ROM) 217 to communicate to the speech synthesizer 216 the appropriate bit sequence indicative of the analogous allophone sequence. This data communicated from the ROM 217 to the speech synthesizer 216 establishes the parameters necessary for the modulation of the speaker 218 in the generation of the synthesized speech.

The speech synthesizer is chosen from a wide variety of speech synthesis means, including, but not limited to, the use of a linear predictive filter.

Figure 3:
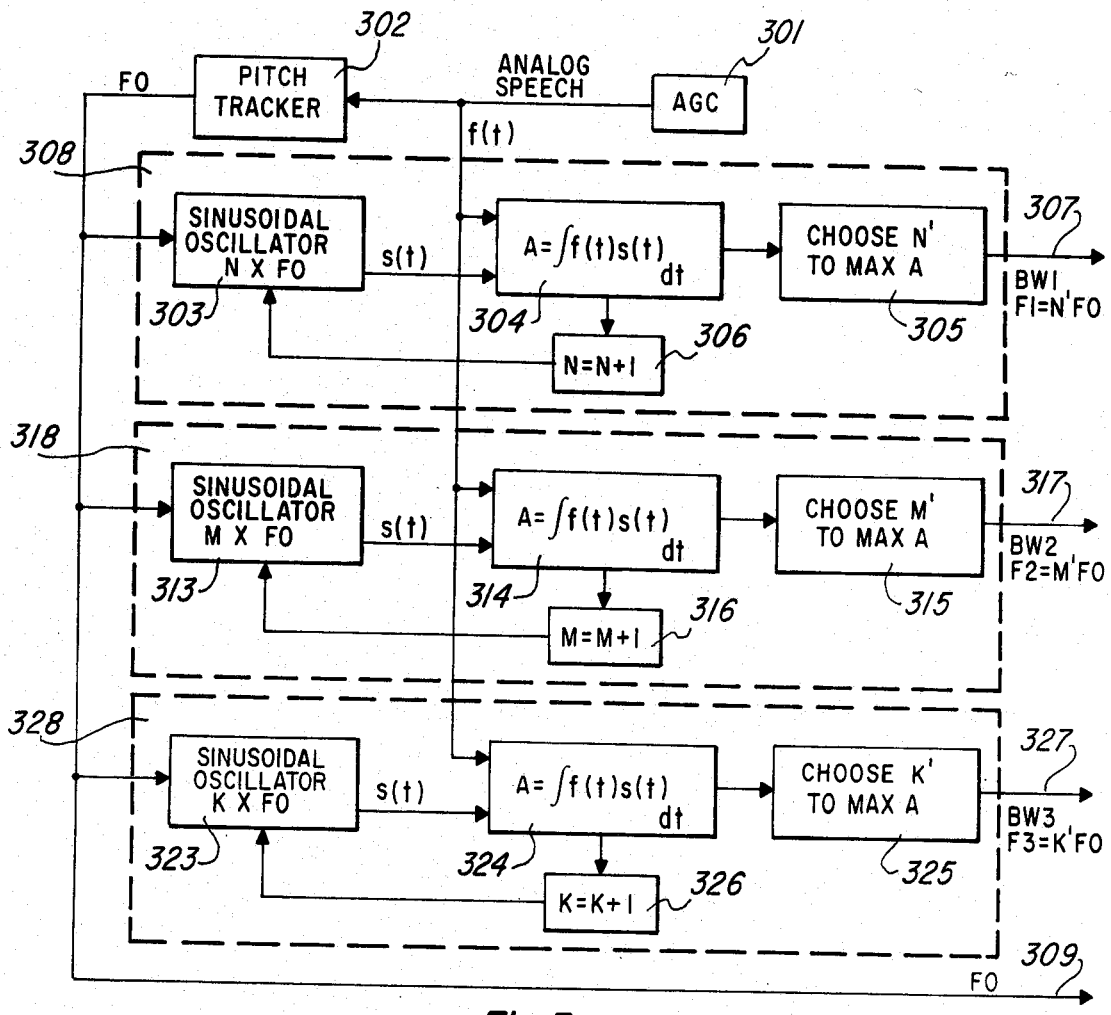
FIG. 3 is an embodiment of the invention utilized to generate indicia representative of the analog speech signal.

FIG. 3 is a block diagram of an embodiment of the invention which generates indicia representative of the analog speech.

This indicia is representative of the perceived phoneme and is used in finding a best match or optimal match with the template in the library. The automatic gain control circuit (AGC) 301 communicates an analog speech signal to the pitch tracker 302 and the integration means 304, 314, and 324. The pitch tracker 302 generates a fundamental frequency FO.

For each formant determiner 308, 318, and 328 a respective set of integers is determined for which the fundamental frequency FO, when multiplied by the integer falls within the formant range. The respective sets of integers are broadened to include an overlap in the sets so that the entire formant is defined. As an example, if the fundamental frequency FO is 200 Hz, the integer set the fundamental frequency may contain (0,1,2,3,4); the second formant integer set contains (4,5,6,7); the third formant integer set contains (7,8,9).

The formant determiner 308 accepts the fundamental frequency FO and utilizes it with an integer value from the integer set for n in the sinusoidal oscillator 303. The sinusoidal oscillator 303 generates a sinusoidal signal, s(t), which is centered at the product n and the fundamental frequency. The sinusoidal signal is communicated to the integrater 304 which integrates the product of the sinusoidal signal s(t) and the analog speech signal, f(t) over the chosen frequency of the formant. This integration by the integrater 304 creates a convolution of the analog speech signal f(t).

This operation involving the generation of a sinusoidal signal by the sinusoidal oscillator 303 and the communication thereof to the integrator 304 is continued for all integer values within the integer set by the incrementer 306. The value of n which generates the maximum amplitude from the integrater 304 is chosen by the determinator 305. This optimal value, N′, is used to generate the first formant F1 defined by $F1=N'\times F0$. This product additionally is determinative of the bandwidth BW1, of the first formant and the pair F1 and BW1 are communicated via channel 307.

In like fashion the formant determiners 318 and 328 generate a sinusoidal signal via the sinusoidal oscillators 313 and 323 respectively and subsequently integrate by the integrators 314 and 324 so as to obtain the optimal values M′ and K′, 315 and 325 respectively.

The indicia BW1, F1, BW2, F2, BW3, F3, and F0, represent the perceived phoneme indicia from the analog speech from the AGC circuit 301. This perceived indicia is used to match the perceived phoneme to a phoneme template in a library so as to obtain a best match.

Figure 4:
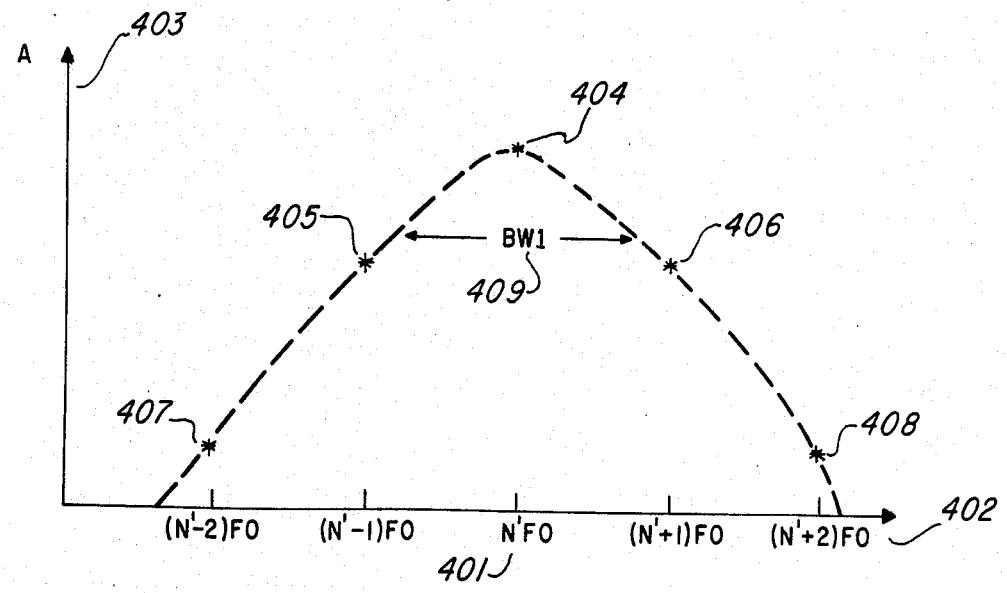
FIG. 4 is illustrative of the determination of the bandwidth associated with a particular formant.

FIG. 4 indicates the relationship of the bandwidth to the optimal formant.

Once the optimal integer value N′ is determined, its amplitude is plotted relative to the surrounding integers. The independent axis 402 contains the frequencies as dictated by the product of the integer value with the fundamental frequency. The dependent axis 403 contains the amplitude generated by the product in the convolution with the analog speech signal. As illustrated, the optimal value N′ generates an amplitude 404. By utilizing the surrounding data points 405, 406, 407, and 408, a bandwidth BW1 is determined for the appropriate optimal value N′.

The use of this bandwidth forms another indicia for determining the perceived phoneme relationship to the phoneme templates of the library. Similar analysis is one for each formant.

Figure 5:
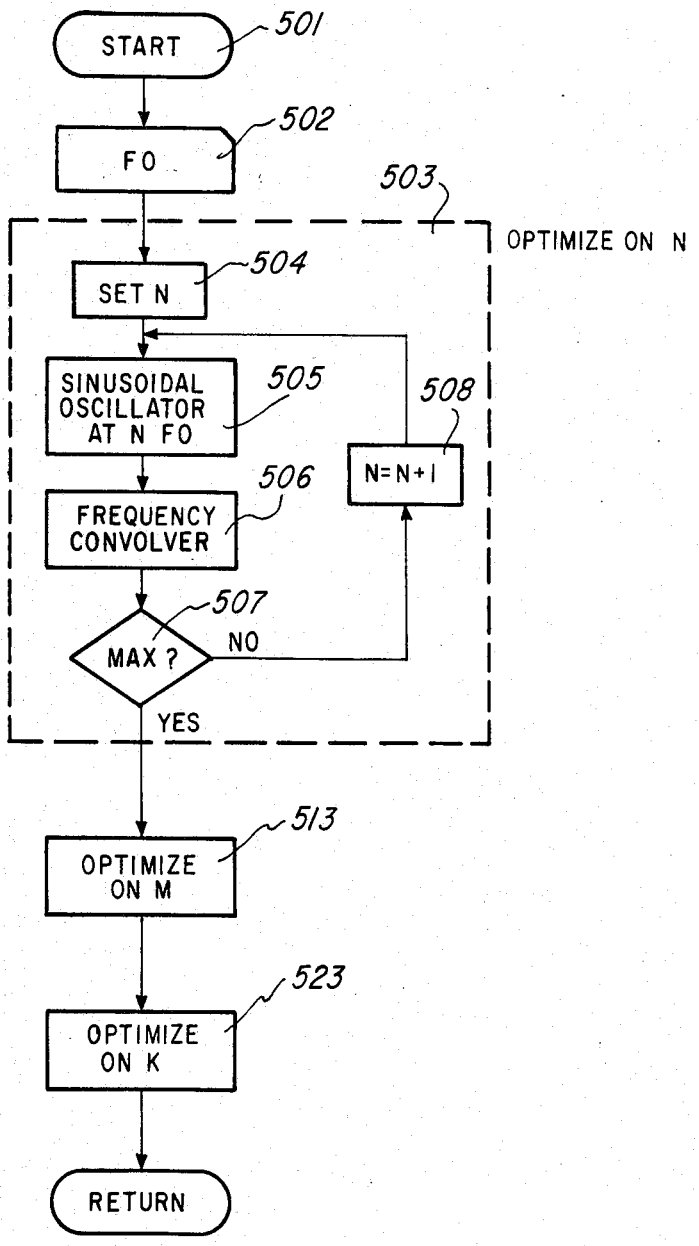
FIG. 5 is a flow chart of an embodiment determining the formant of the analog speech signal.

FIG. 5 is a flow chart of an embodiment for determining the optimal formant positions.

The algorithm is started at 501 and a fundamental frequency, F0, 502 is determined. This fundamental frequency is utilized to optimize on N 503. The optimization on N 503 entails the initialization of the N value 504 followed by the sinusoidal oscillation based at the product of N F0 505. The frequency convolver 506 generates the convolution of the fundamental frequency F0 and the inputted analog speech signal over the chosen frequency of the formant. The convolution is optimized at 507 wherein if it is not the optimal value, the N value is incremented at 508 and the process is repeated until an optimal N value is determined. At the optimization of N, the algorithm proceeds to optimize of the value of M 513 and then to optimize on the value K 523. The optimization on N 503, the optimization of M 513, and the optimization of K 523 are identical in structure and performance.

In this embodiment three formant frequency ranges are utilized to define the human language. It has been found that three ranges accurately describe the human speech, but this methodology is either extendable or contractable at the will of the designer. No loss in generality is encountered when the algorithm is extended to apply to a single formant or similarly to extend to more than three formants.

Figure 6:
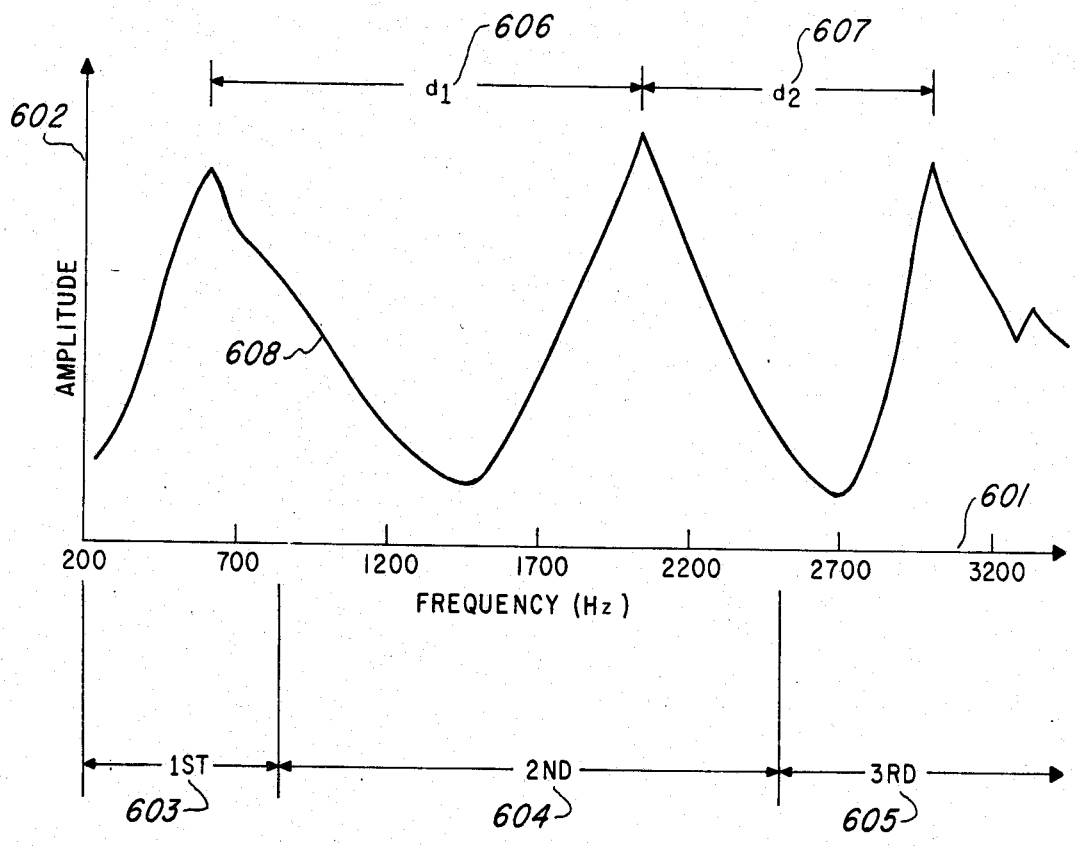
FIG. 6 illustrates a method of determining indicia so as to define a particular formant structure of an analog speech signal.

FIG. 6 graphically illustrates another methodology for the encoding of the analog speech signal in the formants.

The analog speech signal 608 is plotted over the independent axis 601 of frequency. The dependent axis 602 is the amplitude. Within the first formant 603, the frequency range lies between 200 and 700 Hz. The second formant 604 has a frequency range of 850 to 2500 Hz; and the third formant 605 has a frequency range of 2700 to 3500 Hz. A method similar to the methodology discussed in FIG. 3 and FIG. 5 is used to determine the location of the maximum amplitude within the formant range. These maxima yield a distance between maxima, 606 and 607 respectively. The distance, $d_1$,between the optimal first and second formants is used to characterize the perceived phoneme for matching to a phoneme template. This methodology allows two integer values $d_1$ and $d_2$ to describe what previously necessitated the use of three integer values (for the first, second and third formants).

Figure 7:
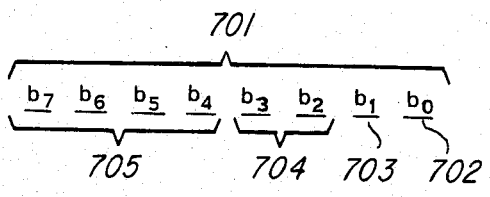
FIG. 7 illustrates an encoding scheme for the indicia.

FIG. 7 is an embodiment of th encoding scheme for establishing a word for matching to the phoneme template.

The data word 701 in this example is an 8 bit word but any length of word which is capable of adequately describing the perceived phoneme is acceptable. In this embodiment the 8 bits are broken up into four basic components, 702,703, 704, and 705.

The first component 702 is indicative of a pause of no pause situation. Hence if $b_0$ is set to a value of 1, a pause has been perceived and the appropriate steps will therefore be taken; similarly a 0 at $b_0$ indicates lack of a pause. A similar relationship exists at bit $b_1$, 703, which indicates a voiced or unvoiced phoneme. Bits $b_2$–$b_3$, 704, indicate the contour of the analog speech signal; its assigned value indicates a level slope, a positive slope or a negative slope.

Bits $b_4$–$b_7$, 705, indicate a mixture of the relative energy, relative pitch, first distance, and second distance. Bits $b_4$–$b_7$, 705, are encoded so that their value indicates the characteristics of the perceived phoneme relating to the formant distances. Bits $b_4$–$b_7$ are encoded to communicate the distances between the maximums within each formant as illustrated in FIG. 6. From table 706, each value within the range of bits $b_4$–$b_7$ absolutely defines the two distances.

Figure 8:
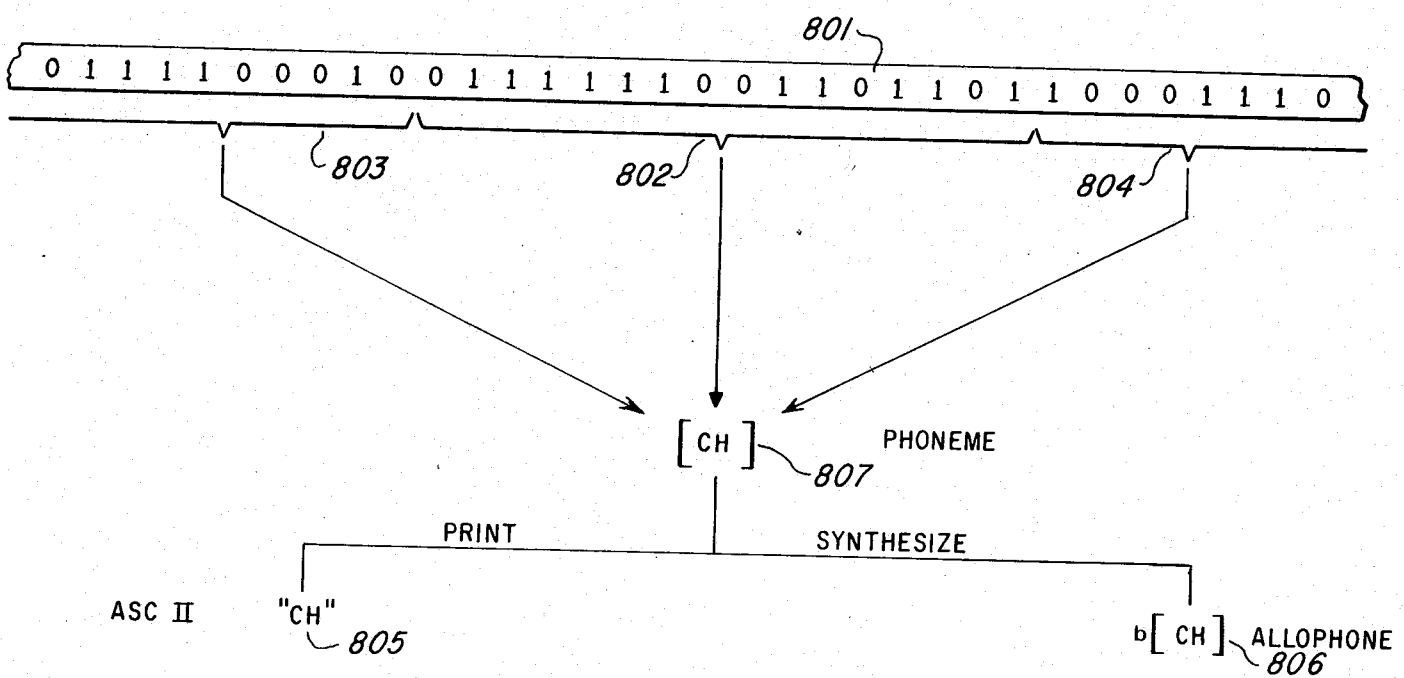
FIG. 8 illustrates a translational operation of a phoneme to either an allophone or alphanumeric characters.

FIG. 8 illustrates the translation of the phoneme code sequence into its appropriate allophone sequence or alternately its alphanumeric counterpart.

The phoneme sequence 801 is broken into its phoneme codes such as phoneme code 802. The phoneme code 802 distinctly describes a particular phoneme 807. This phoneme 807 is either printed as at 805 in its ASCII alphanumeric character or it is translated to its analogous allophone sequence when it is taken in conjunction with the surrounding phoneme codes 803 and 804.

The allophone sequence 806 is generated through the knowledge of the target phoneme 807 and its relationship to its surrounding phonemes. In this context, the phonemes which precede, 803, and follow, 804, the target phoneme 802 are retained in memeory so as to generate the appropriate allophone sequence 806.

Figure 9:
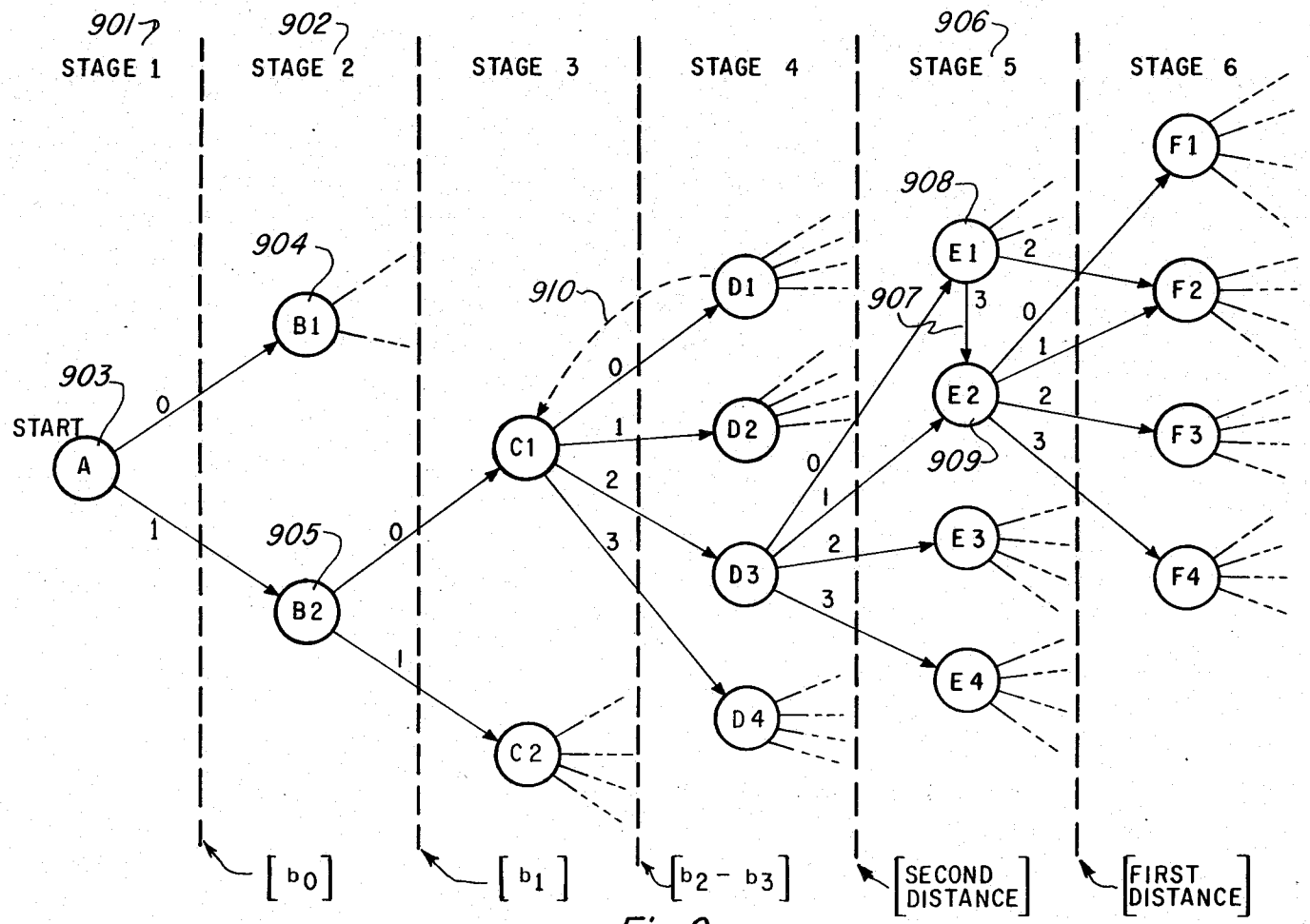
FIG. 9 is an example of a decisional tree operating upon the encoded indicia as representated in FIG. 7.

FIG. 9 illustrates the characteristics of an embodiment of a decisional tree which determines the best approximation of the phoneme template in matching the perceived phoneme.

The decisional tree is broken up into multiple stages 901, 902, etc. Each stage of the tree breaks the perceived phoneme into a feasible and infeasible matches. As the perceived phoneme is further broken into feasible and infeasible states, the infeasible state becomes absorbing and the feasible state decreases so that eventually a single phoneme template is the only possible choice. Hence, the final stage of the tree must consist of as many nodes as there are templates.

The original decision 903 is made on whether the first bit, $b_0$, is either set or not set. If the first bit is set, transition is made to node 905; the nodes which follow node 904, B1, are ignored. This determination on the $b_0$ level results in translating the available phoneme templates into an infeasible set, those lying exclusively behind node 904 and a feasible set, those lying behind node B2, 905. A similar determination is made for each component part of the indicia. In this example, another separation is made on $b_1$ and then on the value of $b_2$–$b_3$. This separation into nodes is continued until a final or terminating node is encountered which uniquely identifies the phoneme template chosen.

Movement is acceptable laterally between nodes such as between nodes E1, 908, and E2, 909 via the ray 907. This movement is permissable so long as a cycle is not thereby created. In this context ray 910 indicates a cycle between D1 and C1. For example, a sequence containing C1-D1-C1-D1-C1 is not acceptable since it is a cycle. This sequence causes a never ending cycle which results in a decision never being made. The one qualification of the tree illustrated in this embodiment is that a decision must eventually be reached.

The algorithm illustrated in FIG. 9 is but one embodiment to identify the best match between the perceived phoneme and the phoneme template. Another approach is to generate a comprising value for each phoneme template relative to the perceived phoneme and then choose the optimal value accordingly. This approach requires more computation and a longer time for its operation.

FIGS. 10*a* and 10*b* illustrate a phoneme to allophone transformation wherein a phoneme is translated to its analogous allophone sequence.

In FIG. 10*a*, a list of the rules in defining the allophone is set forth. As illustrated "b", 1001 illustrates a blank or a word boundary. The different symbols illustrated indicate different allophonic characteristics which are attachable to a phoneme. The syllables are broken by a period ".", 1002. These allophonic rules are combined with the phonemes to generate the appropriate allophone sequence.

FIG. 10*b* illustrates how the phoneme "CH", 1003, translates into an appropriate allophone sequence. Depending upon the preceding and the following phoneme, the phoneme "CH" is either a "b CH", 1004, as in "chain" or lies within a word as illustrated in "CH", 1005, as in "bewitching".

Each phoneme maps into a unique allophone sequence. This allophone sequence is determined through knowledge of the preceeding phoneme and the following phoneme within the phoneme sequence.

The invention as described herein details the use of a voice recognition system which translates the analog speech signal into a phoneme sequence which is more susceptible to compaction, storage, transmission, or translation to an analogous allophone sequence for speech synthesis. The phoneme perception allows for an unlimitable vocabulary to be used and also for a best match to be generated. The use of a best match is acceptable since the human ear acts as a filtering mechanism and the human brain ignores random noise so as to also filter the synthesized speech. The synthesized speech is enhanced dramatically through the translation of the phoneme sequence to an analogous allophone sequence. The stored phoneme sequence is susceptible to being translated to an alphanumeric sequence or for transmission via the radio or telephone lines.

This invention makes it possible for a direct speech to text dictating matchine to be implemented and also can be advantageously employed to produce a highly efficient speech data transmission rate.

I claim:

1. A speech recognition system comprising:

means for analyzing digital speech data representative of an analog speech signal to generate perceived phonemes representative of component parts of said digital speech data;

memory means having encoded digital speech data stored therein, said encoded digital speech data including phoneme codes representative of a plurality of respective reference phonemes, said memory means further having digital speech data stored therein representative of allophones analogous to said phoneme codes;

means operably coupled to said analyzing means and to said memory means for selecting encoded digital speech data representative of a particular reference phoneme from said memory means as the closest match for each of said perceived phonemes of said digital speech data to provide a phoneme code at least approximating each of said perceived phonemes; and means operably coupled to said selecting means and said memory means for forming a phoneme code sequence of a plurality of said phoneme codes, said phoneme code sequence-formeing means being responsive to said phoneme codes as determined by said selecting means to access digital speech data from said memory means representative of analogous allophones corresponding to said phoneme codes.

2. A speech recognition system as set forth in claim 1, wherein the digital speech data operated upon by said analyzing means is representative of an analog speech signal normalized for pitch and speed such that the allophones represented by the digital speech data as accessed from said memory means by said phoneme code sequence-forming means more nearly approximate the original analog speech signal.

3. A speech recognition and systhesis system comprising:

means for analyzing digital speech data representative of an analog speech signal to generate perceived phonemes representative of component parts of said digital speech data;

memory means having encoded digital speech data stored therein, said encoded digital speech data including phoneme codes representative of a plurality of respective reference phonemes, said memory means further having digital speech data stored therein representative of allophones analogous to said phoneme codes;

means operably coupled to said analyzing means and to said memory means for selecting encoded digital speech data representative of a particular reference phoneme from said memory means as the closest match for each of said perceived phonemes of said digital speech data to provide a phoneme code at least approximating each of said perceived phonemes;

means operably coupled to said selecting means an said memory means for forming a phoneme code sequence of a plurality of said phoneme codes, said phoneme code sequence-forming means being responsive to said phoneme codes as determined by said selecting means to access digital speech data from said memory means representative of analogous allophones corresponding to said phoneme codes;

speech synthesizer means operably coupled to the output of said phoneme code sequence-forming means for processing the digital speech data representative of allophones provided thereby to generate an analog speech signal; and audio means coupled to said speech synthesizer means for converting said analog speech signal generated thereby into audible synthesized speech coresponding to the original analog speech signal.

4. A speech recognition and systhesis system as set forth in claim 3, wherein the digital speech data operated upon by said analyzing means is representative of an analog speech signal normalized for pitch and speed such that the allophones represented by the digital speech data as accessed from said memory means by said phoneme code sequence-forming means more nearly approximate the original analog speech signal.

5. A speech recognition and systhesis system as set forth in claim 4, wherein the digital speech data representative of allophones as stored in said memory means comprises speech parameters including linear predictive coding reflection coefficients; and said speech synthesizer means is a linear predictive coding speech synthesizer means is a linear predictive coding speech synthesizer.

6. A vocoder comprising:

means for analyzing digital speech data representative of an analog speech signal and identifying phoneme components of said digital speech data;

library means storing digital speech data including encoded digital speech data in the form of phoneme codes representative of a plurality of reference phonemes comprising all of the recognized phonemes in a given spoken language, each of which has an associated set of allophone characteristics corresponding thereto stored as digital speech data in said library means;

comparator means operably coupled to said analyzing means and said library means for obtaining the closest match from said plurality of reference phonemes as represented by the encoded digital speech data stored in said library means to said phoneme components of said digital speech data to provide a phoneme code at least approximating each of said phoneme components of said digital speech data identified by said analyzing means;

means for providing a phoneme code sequence of connected phoneme codes corresponding to the respective reference phomemes from said phoneme codes stored in said library means which are the closest match to said phoneme components of said digital speech data representative of said analog speech signal;

said library means being responsive to said phoneme code sequence to provide a phoneme-to-allophone translation in communicating digital speech data representative of allphones to said phoneme code sequence-forming means;

speech synthesizer means connected to the output of said phoneme code sequence-forming means for processing the digital speech data representative of allophones provided thereby to generate an analog speech signal; and audio means coupled to said speech synthesizer means for converting said analog speech signal generated thereby into audible synthesized speech corresponding to the original analog speech signal.

7. A vocoder as set forth in claim 6, wherein the digital speech data operated upon by said analyzing means is representative of an analog speech signal normalized for pitch and speed such that the allophones represented by the digital speech data communicated from said library means to said phoneme code sequence-forming means more nearly approximate the original analog speech signal.

8. A vocoder as set forth in claim 7, wherein the digital speech data stored in said library means and representative of allophones comprises speech parameters including lnear predictive coding reflection coefficients, and said speech synthesizer means is a linear predictive coding speech synthesizer.

9. A method of analyzing a speech signal and producing audible synthesized speech comprising:

providing an analog speech signal;

identifying phoneme component parts of said analog speech signal;

comparing each of the phoneme component parts as identified from said analog speech signal with a plurality of reference phonemes comprising all of the recognized phonemes in a given spoken language;

obtaining the closest match from said plurality of reference phonemes to each of the identified phoneme component parts of said analog speech signal to provide respective phoneme codes at least approximating each of the identified phoneme component parts;

forming a phoneme code sequence of connected phoneme codes as determined by the matching of the closest reference phoneme to each of the identified phoneme component parts of said analog speech signal;

translating the formed phoneme code sequence into an analogous allophone sequence thereto;

generating analog signals representative of synthesized speech from said allophone sequence; and producing audible synthesized speech corresponding to the original analog speech signal from said analog signals representative of synthesized speech.

10. A method as set forth in claim 9, further including normalizing said analog speech signal by setting the pitch and speed thereof in accordance with the voice of a user prior to the identification of said phoneme part components thereof such that the subsequent translation of said phoneme code sequence to said allophone sequence enables the audible synthesized speech produced therefrom to more nearly approximate the original analog speech signal.

* * * * *